US008485243B2

(12) United States Patent
Kinney

(10) Patent No.: US 8,485,243 B2
(45) Date of Patent: Jul. 16, 2013

(54) METHOD FOR CASTING A COMPONENT

(75) Inventor: Christopher A. Kinney, Iuka, MS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/267,181

(22) Filed: Oct. 6, 2011

(65) Prior Publication Data

US 2012/0024491 A1 Feb. 2, 2012

Related U.S. Application Data

(63) Continuation-in-part of application No. 11/731,459, filed on Mar. 30, 2007, now abandoned.

(51) Int. Cl.

| | |
|---|---|
| ***B22D 19/00*** | (2006.01) |
| ***B22D 19/02*** | (2006.01) |
| ***B22D 19/10*** | (2006.01) |

(52) U.S. Cl.
USPC ..... 164/98; 164/103; 164/92.1

(58) Field of Classification Search
USPC ..... 164/92.1, 98, 100, 103
See application file for complete search history.

(56) References Cited

U.S. PATENT DOCUMENTS

| | | | |
|---|---|---|---|
| 3,170,452 | A | 2/1965 | Dobovan |
| 3,524,493 | A | 8/1970 | Doll et al. |
| 4,337,736 | A | 7/1982 | Rasch et al. |
| 4,487,175 | A | 12/1984 | Krczal |
| 4,908,923 | A | 3/1990 | Anderson et al. |
| 5,445,210 | A | 8/1995 | Brassell |
| 5,678,753 | A | 10/1997 | Stauder |
| 5,954,038 | A | 9/1999 | Warwick et al. |
| 7,047,612 | B2 | 5/2006 | Bridges et al. |
| 2004/0206726 | A1 | 10/2004 | Daemen et al. |
| 2004/0216295 | A1 * | 11/2004 | Bridges et al. ..... 29/402.09 |

FOREIGN PATENT DOCUMENTS

| | | |
|---|---|---|
| DE | 3837254 | 5/1990 |
| DE | 29724028 | 8/1999 |
| EP | 0440093 | 8/1991 |
| FR | 2114283 | 6/1972 |
| JP | 58062344 | 4/1983 |

OTHER PUBLICATIONS

Stucky M., "Les inserts dans les alliages d'aluminium moules", Fonderie, Fondeur d'aujourd'hui, Editions Techniques des Industries de la fonderie, Sevres, FR, No. 123, Mar. 1, 1993, pp. 37-41, XP000355032, ISSN: 0249-3136.

* cited by examiner

*Primary Examiner* — Kevin P Kerns
(74) *Attorney, Agent, or Firm* — Liell & McNeil; Kevin C. Earle

(57) ABSTRACT

A cast component having localized areas of improved physical properties is disclosed. The component may initially be produced having a void portion in a predetermined area requiring improved physical properties. A second molten material may be added to the void portion such that it chemically bonds to the void portion. The component may then be finished such to a final shape with a localized area of improved physical properties.

19 Claims, 6 Drawing Sheets

METHOD FOR CASTING A COMPONENT

CROSS-REFERENCE TO RELATED APPLICATIONS

This application is a continuation-in-part of U.S. patent application Ser. No. 11/731,459, filed Mar. 30, 2007, now abandoned.

TECHNICAL FIELD

The present invention relates to casting a component having localized areas of improved physical properties.

BACKGROUND

Cast components are often designed to the limit of their mechanical properties to take advantage of strength to weight ratios. The requirement for more stringent emissions is also a contributing factor due to seeking high combustion pressures and temperatures. Because of the physical characteristics of cast materials, specifically gray cast iron in engine applications, the thermal fatigue limit is often reached causing failure in certain areas of the component. When this happens, it is difficult and time consuming to repair castings and other components often resulting in significant downtime and costs for the component owner. Typically repairs to castings involve removing damaged portions of the casting through machining, and subsequently rebuilding the damaged area by welding.

An example of a component that is susceptible to damage is the cylinder head of an internal combustion engine. Because of repeated heating and cooling of the engine, the cylinder heads often reach their thermal fatigue limit and develop cracks near openings, such as valve seats, fuel injector bores, and exhaust ports. Another problem associated with cylinder heads is warping. When warped, the bottom surface of the head becomes uneven and does not seal properly. Some warped cylinder heads can be milled until the fireside surface is again flat. However, milling the surface reduces the thickness of the head, making the head more susceptible to future operating damage. Heads that can't be milled flat are typically scrapped.

One example of producing a casting having localized areas of improved thermal resistance of the cylinder head is U.S. Pat. No. 4,337,736 (the'736 patent) issued to Raush et al. The '736 patent discloses a cast iron cylinder head having a preformed workpiece of a thermal fatigue-resistant alloy material metallically bonded to the cylinder head around the valve bridge area to provide reinforcement in this area. The preformed workpiece has thin fusible sections, which melt when the hot base material is cast over them. Although the disclosure of the '736 patent may provide for localized areas of improved thermal resistance, it may be costly and have limited applicability.

The present disclosure is directed to overcoming one more of the problems set forth above.

SUMMARY OF THE INVENTION

It is to be understood that both the foregoing general description and the following detailed description are exemplary and explanatory only and are not restrictive of the invention as claimed.

In one aspect, a method of producing a component for a machine system having dissimilar properties in a base portion and an insert portion of the component includes preheating a base portion of the component formed of a base material, and adding a molten filler material for forming an insert portion of the component into a void in the base portion. The method also includes further heating preheated base material surrounding the void via the molten filler material such that the filler material chemically bonds with the surrounding base material, and cooling the component such that different microstructures according the dissimilar properties are formed in each of the surrounding base material of the base portion and adjacent filler material of the insert portion.

In another aspect, a method of preparing a component for service in a machine system includes preheating a base portion of the component formed of a base material and defining a finite number of voids, and adding a molten filler material into all of the voids. The method also includes further heating preheated base material surrounding each one of the voids via the molten filler material such that the filler material chemically bonds with the surrounding base material. The method further includes cooling the component such that an insert portion of cooled filler material forms within each one of the voids, and forming a first microstructure in the insert portions which is different from a second microstructure in the base portion, via cooling the component.

In still another aspect, a method of preventing thermal fatigue damage in a component of a machine system includes heating a base portion of the component defining a finite number of voids and being formed of a base material at least in part via adding a molten filler material into all of the voids, such that the filler material chemically bonds with base material surrounding each one of the voids. The method further includes cooling the component such that added filler material forms an insert portion within each one of the voids, and forming an inhomogeneous, crack-propagation-defeating microstructure in the base portion and in the insert portions, at least in part via cooling the component.

BRIEF DESCRIPTION OF THE DRAWINGS

The accompanying drawings, which are incorporated in and constitute a part of this specification, illustrate several exemplary embodiments of the invention and, together with the description, serve to explain the principles of the invention. In the drawings.

DETAILED DESCRIPTION

Figure 1:
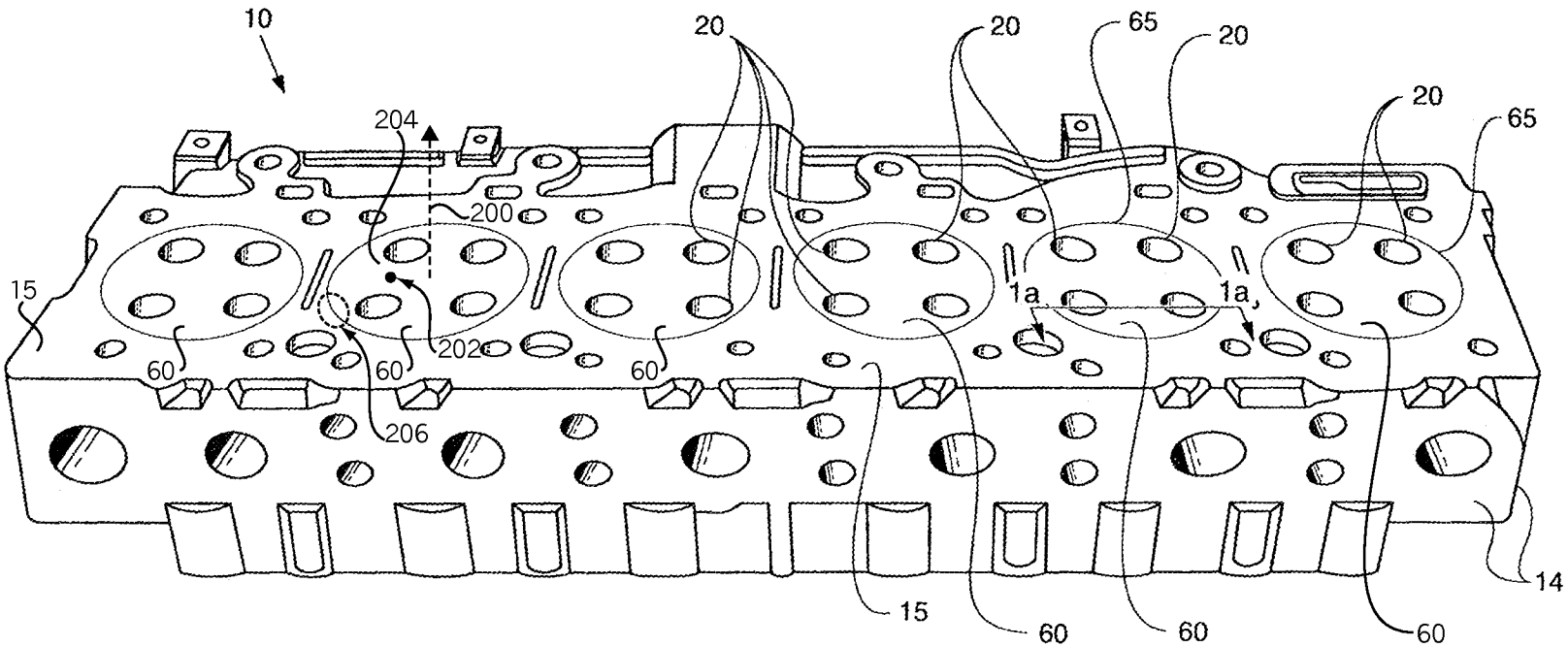
FIG. 1 is an elevated view of a bottom surface of a cylinder head according to an embodiment of the present disclosure.

FIG. 1 is an elevated view of a bottom (fireside) surface 12 of a component, in this case a cylinder head 10, according to an embodiment of the present disclosure. The cylinder head 10 may include a first component portion or base portion 15 and a second component portion or insert portion 60 separated by a bond layer 65. In one embodiment, cylinder head 10 may include a plurality of second component portions, for instance a total of six. In this instance, the cylinder head 10 may be in a rough state after casting and some machining. The cylinder head 10 may include a plurality of side surfaces 14 in addition to the fireside surface 12 and a top surface (not shown). The fireside surface 12 may be cast with a plurality of valve openings 20 associated with each cylinder (not shown), and being formed at least partially within second component portions 60. The fireside surface 12 may be fastened to an engine block (not shown) after final machining the fireside surface 12, the valve openings 20, and other necessary openings, such as the fuel injector openings (not shown) associated with each cylinder (not shown). Each second component portion 60 defines a longitudinal axis 200, one of which is illustrated, which typically will be collinear with a center axis of the corresponding cylinder.

A cylinder head is only one example of a component for a machine system such as an internal combustion engine system which may be produced according to the present disclosure. As will be further apparent from the following description, many other applications of the teachings set forth herein are contemplated, outside of the context of an internal combustion engine system. Methodologies discussed herein enable dissimilar properties to be accorded to a base portion such as cylinder head 10 versus an insert portion such as second component portions 60. The dissimilar properties may include dissimilar strength, thermal fatigue resistance, hardness, and a variety of other properties related to or arising out of microstructures of the different component portions. One practical implementation strategy contemplates forming second component portions 60 such that they have a relatively finer microstructure as compared to a relatively coarser microstructure of cylinder head 10, as this may accord a relatively greater thermal fatigue resistance to part or all of the filler material comprising second component portions 60 as compared to the base material comprising cylinder head 10. As further described herein, in other instances it might be desirable to form an insert portion with a lesser thermal fatigue resistance than a base portion. As alluded to above, various combinations of dissimilar properties as well as gradients of dissimilar properties in localized areas will be possible by following the teachings set forth herein. Whatever the different microstructures and dissimilar properties desired, the present disclosure is contemplated to be applicable to producing new components where no parts thereof have experienced a service life, but may also find application in instances where a component to be produced includes parts which have been removed from prior service in a machine system.

Figure 1A:
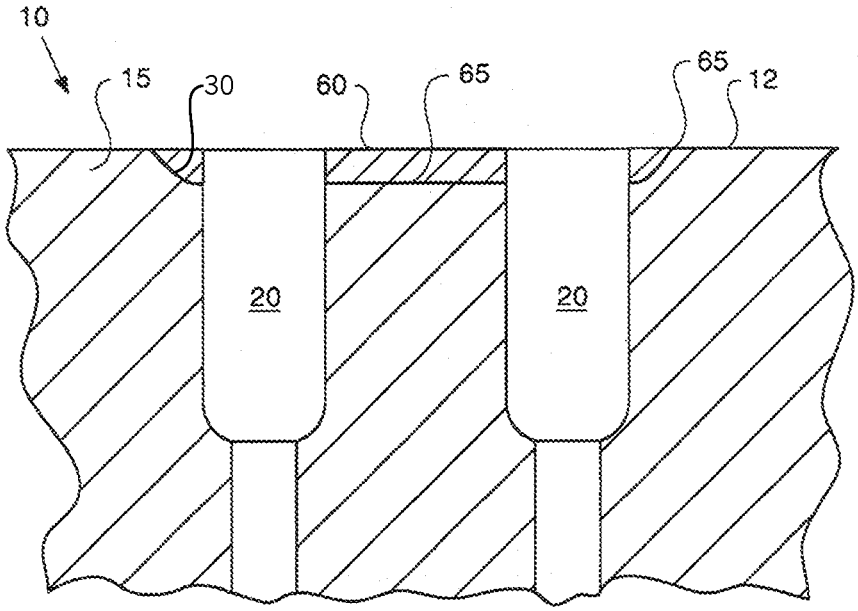
FIG. 1*a* is a sectional view of the cylinder head of FIG. 1 taken along line 1*a*-1*a;*

FIG. 1*a* is a sectional view of the cylinder head 10 of FIG. 1 taken along line 1*a*-1*a*. The valve openings 20 are more clearly shown extending through the second component portion 60 and into the first component portion 15. A bond layer 65 is shown representing a metallurgical, and chemical, bond between the first component portion 15 and the second component portion 60. In one embodiment, bond layer 65 may comprise a blended microstructure at an interface of second component portions 60 and cylinder head 10, the significance of which will be apparent from the following description. A gray cast iron cylinder head 10 may be used, however, it should be appreciated that the present disclosure is not limited to use with cylinder heads 10 cast from an iron containing base material having a graphitic microstructure such as gray iron, but may be applied to other cast and non-cast components made from various other metallics, such as ductile iron, wrought steel, mild steel, stainless steel, aluminum and the like. While the second component portion 60 may be formed from iron containing filler material, e.g. also gray iron, the second component portion 60 may be any one of a number of other materials, such as ductile iron, mild steel, stainless steel, austenitic nickel-chromium-based superalloys available under the trade name INCONEL®, aluminum and the like depending on compatibility with the first component portion 60. In the case where the base material of the first component portion 15 and the second component portion 60 is the same, the microstructure of the second component portion 60 may differ significantly from the first component portion 15, thereby imparting different physical properties, as mentioned above. Where the base material and filler material differ, microstructure may also differ, but different physical properties may of course also be imparted by the inherently different properties of the two materials.

Figure 2:
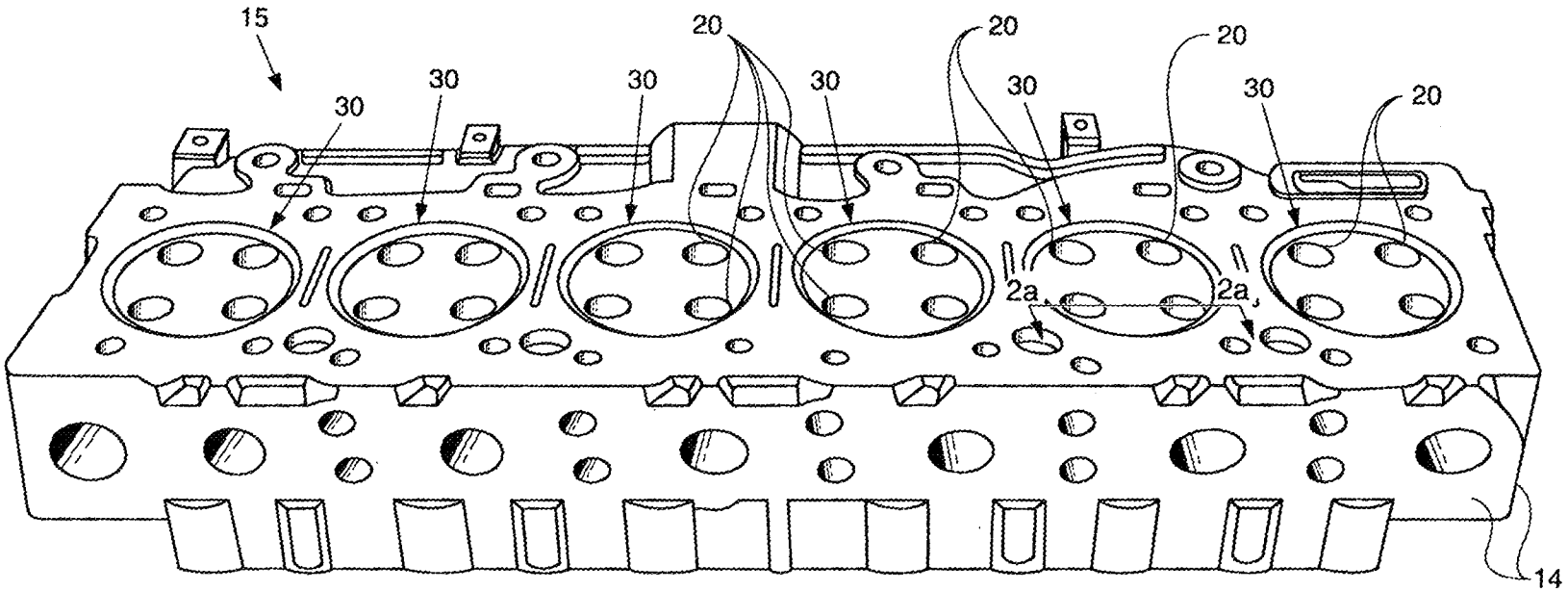
FIG. 2 is an elevated view of the bottom surface of a first component portion of the cylinder head of FIG. 1 according to an embodiment of the present disclosure.
Figure 2A:
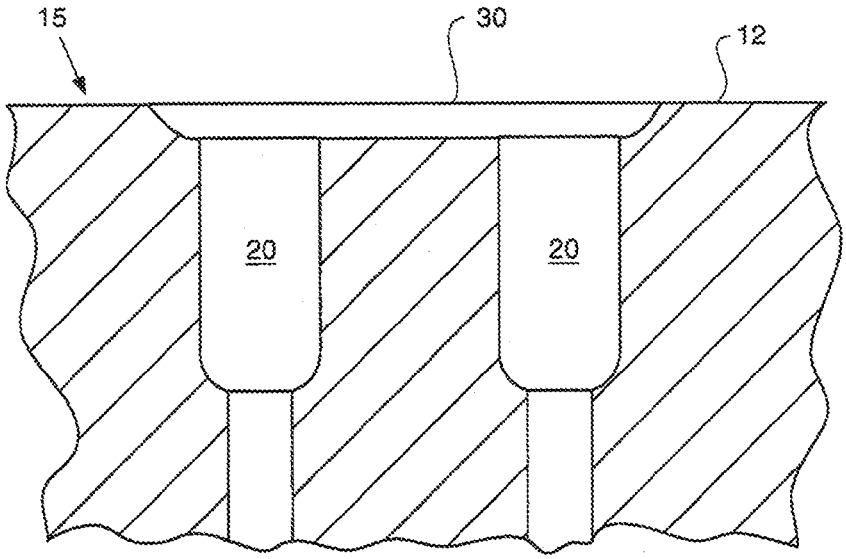
FIG. 2*a* is sectional view of the first component portion of FIG. 2 taken along line 2*a*-2*a;*

FIG. 2 is an elevated view of the bottom surface of a first component portion 15 of the cylinder head 10, which will be understood as part of the base portion comprised of cylinder head 10 and thus formed of the base material, according to an embodiment of the present disclosure. A plurality of void portions 30 may be produced in and defined by the first component portion 15. Base material may thus be understood as surrounding the void portions 30, one of which is shown. Filler material comprising the second component portion 60 shown in FIG. 1A will be understood to be adjacent to the surrounding base material, while bond layer 65 adjoins the base and filler materials. In at least certain embodiments, bond layer 65 may be a blend of the chemically bonded base and filler materials. FIG. 2*a* is a sectional view of the first component portion 15 of FIG. 2 taken along line 2*a*-2*a*. The sectional view more clearly shows the void portion 30 and valve openings 20 cast into the cylinder head 10. The void portion 30 may be structured to receive a quantity of molten filler material to form the second component portion 60. Since the molten filler material cools to form the second component portion 60, the terms "filler material," "second component portion," and "insert portion" may be interchanged throughout the disclosure and the figures.

Figure 3:
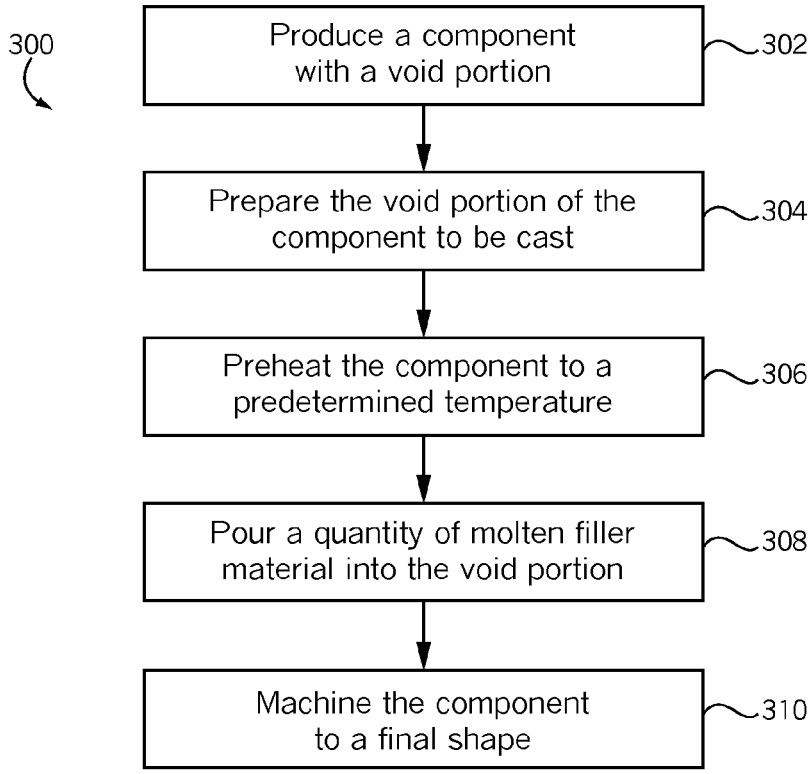
FIG. 3 is a flowchart describing a method of producing a component according to one embodiment of the present disclosure.

Referring now to FIG. 3, a flowchart 300 is provided describing a method of producing a component 10 for machine system according to one embodiment of the present disclosure. In the first control block 302, the first component portion 15 of the component 10 may be produced with a void portion 30 in a predetermined area. This may be represented as shown in FIGS. 2 and 2*a*. Production of the first component portion 15 having at least one void portion 30 may be by any one of a number of operations, such as casting, forging, machining and the like. The void portion 30 may be created such that void portion 30, itself, may provide for an area to receive and contain the molten filler material 60 without a mold being necessary to the operation. In control block 304, the void portion 30 may be cleaned up as necessary to provide a surface suitable for forming a metallurgical bond upon the addition of a molten filler material 60. This may not always be required, but may include machining and the like to provide an oxide free surface in the void portion 30. Procedures in block 304 may include machining at ambient temperatures.

In the third control block 306, the component 10 may be preheated to a predetermined temperature, for instance in an oven or the like. The preheat temperature will vary depending on the type and thickness of base material surrounding the void portion 30 and the type and amount of molten filler material 60 being added to the void portion 30. For proper determination of preheat temperature, computer simulation or experimentation may be necessary. It may desirable to preheat the first component portion 15 as much as possible without damaging the component 10. Depending on the component 10, types of damage may include stress relieving and warping caused by overheating or melting of the original surface. On the other hand, failure to preheat the component 10 to high enough of a temperature may cause cracking of the parent material when the melted filler material is poured or lack of bonding between the two materials. In one embodiment, the preheat temperature for a cast iron cylinder head 10 may be in the range of 950° F. to 2000° F. For certain types of cylinder heads 10 such as those formed of gray cast iron, a preheat temperature of 1100° F. has been found to reduce stress and warping while reducing the risk of cracking. The preheat temperature will, in any event, be less than a melting temperature of the base material. Following initial preheat, component 10 may be removed from the oven, and additional preheating performed locally to increase a temperature of base material surrounding the void to nearly molten. A hand-held torch or the like may be used for the local preheating, and an infrared camera used to confirm that the subject base material is sufficiently preheated.

In the fourth control block 308, a quantity of filler material 60, or second component portion, is melted and poured into the void portion 30 of the first component portion 15. As the melting point of the first component portion 15 and the second component portion 60 may be the same or may be different, the melting point of the second component portion 60 may be exceeded to cause further heating of the first component portion 15 at the void portion 30. In other words, the molten filler material may be superheated. This enables the filler material to remain molten in anticipation of controlled cooling and crystallization and also brings up and/or maintains the temperature of the surrounding base material. As the molten filler material 60, or second component portion, and the first component portions cool, a metallurgical and chemical bond may be formed between the filler material 60 and the first component portion 10 at a bond layer 65. In the final control block 310, the component 10, including the solidified filler material 60, may be machined to a final component shape.

INDUSTRIAL APPLICABILITY

Embodiments of the present disclosure may be applicable to produce a variety of components having localized areas of improved physical properties, such as improved thermal fatigue properties, strength, hardness, and the like. Referring now to FIGS. 2*a*, 2*b*, 2*c* and 2*d*, a method for casting a molten filler material 60 onto a solidified parent material prepared with a void portion 30 will be described in detail.

As shown in FIG. 2*a*, the first component portion 15 may be produced with a void portion 30 in a predetermined location to receive a molten filler material 60. The terms "void portion, or "void" as used herein should be understood to refer to macroscopic voids, and may vary in size and shape depending upon the application. The void portions may be finite in number, and all formed within fireside surface 12 in cylinder head 10, such that the microstructures ultimately obtained are resident on fireside surface 12. The void portion 30 may be designed into the component 15 at a predetermined location in place of a portion of the component 15 where experience has shown similar components have failed or needed repair, such as thermal fatigue sensitive locations. Critical or crack prone areas identified through experience or finite element analysis may be typical areas to which the present disclosure may be applied. It is envisioned that the void portion 30 may be cleaned up as necessary to provide a surface suitable for forming a metallurgical bond upon the addition of a molten filler material 60. In FIG. 1, bridges 204 extend between adjacent valve openings 20, each of bridges 204 having a radial center point 202. Experience has shown that these bridges can crack during service, thus one implementation of the present disclosure contemplates forming second component portions 60 such that they include all of the bridges 204 in cylinder head 12, or at least a part of all of bridges 204, as further described herein.

Figure 2B:
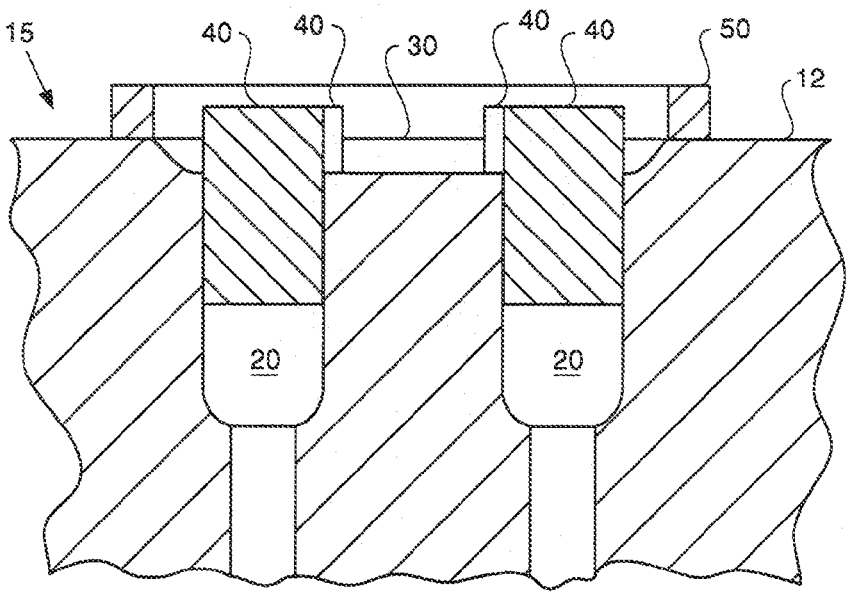
FIG. 2*b* is a sectional view of the first component portion of FIG. 2 taken along line 2*a*-2*a* including a dam and plugs.

FIG. 2*b* is a sectional view of the first component portion 15 of FIG. 2 taken along line 2*a*-2*a* including a dam 50 and removable plugs 40. Plugs 40 may prevent the molten filler material 60 from entering original features of the cylinder head 10. The plugs may be manufactured from a heat resistant material, such as machinable graphite and the like. In one embodiment the plugs may be capable of withstanding extreme temperatures without deforming and may be thermally conductive. The plugs 40 may not be necessary, but may also be of a variety of shapes and sizes to fill specific features. For example, a plug 40 to fill and protect a valve opening 20 is machined to a size and shape substantially equal to that of its respective rough valve opening 20. The plug 40 may be pushed into the valve opening 20, preventing filler material 60 from running through or otherwise filling the valve opening 20. Additionally a dam 50 may be positioned around the void portion 30 on the fireside surface 12. The dam 50 may be positioned on the fireside surface 12 in a manner where pouring the molten filler material 60 into the void portion 30 provides a riser of filler material 60. The dam 50 may be made of machinable graphite similar to the plug 40. The dam 50 may allow for a surplus of molten filler material 60 to be added to the void portion 30 to allow for shrinkage during cooling.

As described in the third control block 306, the cylinder head 10 may be preheated in an oven to a first temperature. In one embodiment the first temperature range is in the range of 950° F. to 2000° F., more preferably 1050° F. to 1150° F. From the preheat oven, the cylinder head 10, with the graphite plugs 40 and dams 50 in position, may be moved to a heated and insulated box (not shown) adapted to maintain the first temperature range and allow for addition of the molten filler material 60.

A quantity of filler material 60, such as cast iron, or other material suitable to attain the desired gradient properties in the void portion 30, is prepared by melting. For example, the filler material 60 may be melted in a crucible and held in a furnace at a temperature sufficient to complete a porosity free bond with the parent or base material. In the case of a cylinder head 10, the temperature may be approximately 2725° F. The filler material 60 may be of a chemical composition similar to that of the cylinder head 10 or component, or it could be quite different depending on the properties desired.

It is envisioned in the present disclosure that it may be necessary to locally heat the void portion 30 of the first component portion 15 to a second predetermined temperature. The second predetermined temperature may vary depending upon the type, mass and wall thickness of the parent material and the volume of filler material 60. The second predetermined temperature range is hot enough to permit chemical bonding of the void portion 30 and filler material 60, but cool enough to prevent the filler material 60 from melting through the parent material of the void portion 30. Rather, it is desirable to promote mixing of the interfacing base material and filler material to form bond layer 65. The lower limit of the range may be determined through simulation and/or experimentation and may account for factors such as material shrinkage, bonding strength, microstructure, and stress associated with the parent and/or filler material. Factors that impact bonding point may include type and volume of the parent material, the type and volume of the filler material, and the chemistry of the parent component. Additionally, the second preheat temperature may prevent rapid cooling of the filler material 60, in turn maintaining desired mechanical properties. Additionally or alternatively, the molten filler material 60 may be heated beyond its melting point to further increase heating of the first component portion 15, as mentioned above.

Figure 2C:
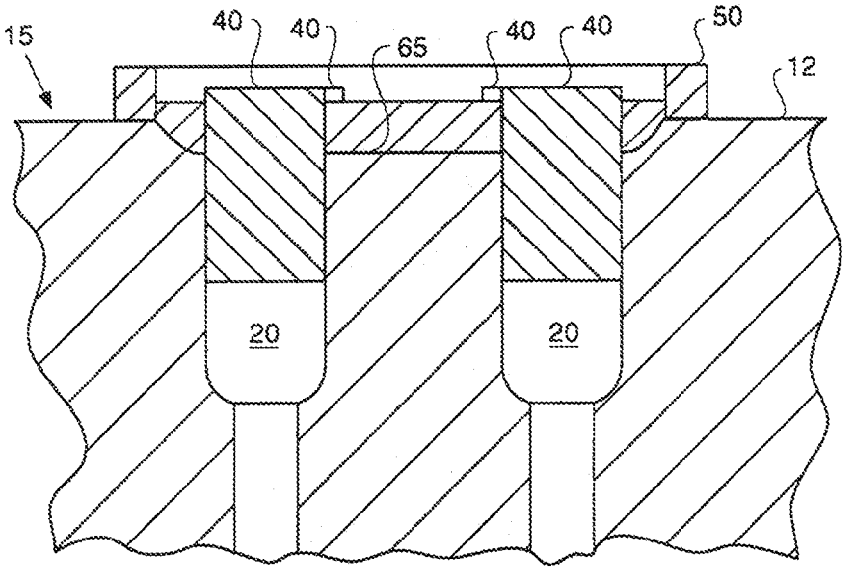
FIG. 2*c* is sectional view of the first component portion of FIG. 2 taken along line 2*a*-2*a* after the addition of a second component portion.

A quantity of welding flux (not shown) may also be applied to the void portion 30. The flux may act to remove oxidation, other contaminants, and aids in wetability of the filler material 60 onto the void portion 30 after the molten filler material 60 is poured. A typical flux may be manufactured from a borax-based material. With the temperature of the void portion 30 within the second temperature range, molten filler material 60 may be removed from the furnace. Slag that may be floating on the surface of the molten filler material 60 may be skimmed from the melted filler material. With the molten filler material 60 substantially free of slag, it is poured into, and fills the void portion 30 as shown in FIG. 2*c*. In one embodiment, filler material may be permitted to overflow from the void portion 30 and rise above the bottom surface 12 along the dam 50.

Figure 2D:
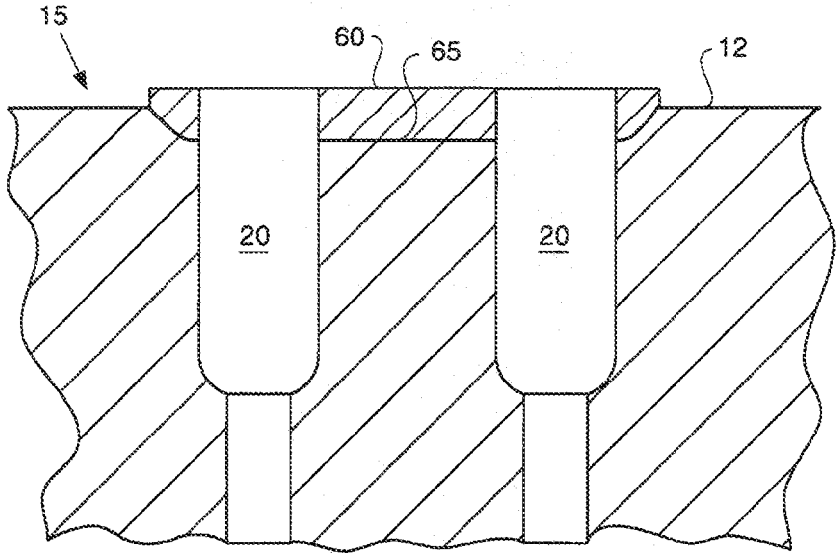
FIG. 2*d* is a sectional view of the first component portion of FIG. 2 taken along line 2*a*-2*a* after adding the second component portion and removing the dam and plugs.

After addition of the molten filler material 60, the component 10 may then be allowed to cool. In one embodiment, the component 10, or a portion thereof, may be partially cooled using compressed air. A wand (not shown) having a diffuser attached thereto and being attached to a compressed air source may be moved about, over the filler material 60. In one embodiment, to achieve desired mechanical properties, such as hardness and microstructure, it is desired to employ a cooling rate sufficient enough, depending on chemistry, to cool the entire volume of the void portion 30 to achieve desired microstructure, or transformation products, of the matrix structure at the newly formed bond layer 65 between the void portion 30 and the filler material 60. For example using cast iron and dependent on the volume of material affected, beginning while the filler material is still at about 900° C. (1652° F.) or above it may be desired to bring the temperature of the filler material within the void portion 30 down to a range of 1100° F. to 1200° F. in a time period of 30 to 180 seconds. After all void portions 30 have been filled, the cylinder head 10 may be cooled, preferably, at a rate slow enough to avoid distortion or cracking of the component. As an example, cooling may occur at a rate of 200° F. per hour or less. The plugs 40 and dams 50 may then be removed as shown in FIG. 2*d*. The cylinder head 10 may then be machined to specifications to form necessary valve seats (not shown) and fuel injector openings (not shown) such that the cylinder head 10 may be assembled for use and placed in service.

Figure 4:
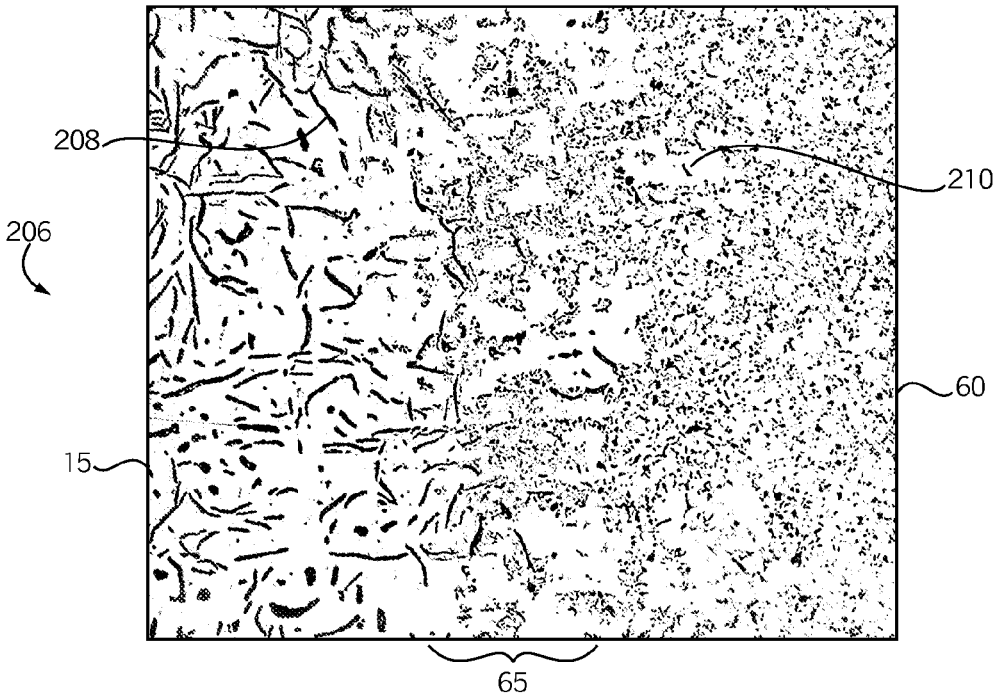
FIG. 4 is a close-up view of a portion of a component according to the present disclosure, illustrating a microstructure gradient.

Referring now to FIGS. 1 and 4, FIG. 4 illustrates a detailed enlargement of the microstructure of cylinder head 10 at a location which includes part of base portion 15, and also part of one of insert portions 60, the enlarged region being denoted via reference numeral 206 in FIG. 1. As discussed above, when cylinder head 10 cools, different microstructures according dissimilar properties may result in surrounding base material of base portion 15 and adjacent filler material of insert portion 60. In one practical implementation strategy, the surrounding base material and adjacent filler material define a microstructure gradient. In FIG. 4, reference numeral 208 identifies the example microstructure of base portion 15, whereas reference numeral 210 identifies microstructure of insert portion 60. Bond layer 65 extends between the adjacent base material and filler material. As also noted above, base portion 15 may be formed of gray cast iron, and insert portion 60 may also be formed of gray cast iron. During cooling component 10, and in particular accelerating cooling of component 10 by way of applying compressed air to insert portion 60 and to a lesser extent to surrounding base material, a finer microstructure may be formed in insert portion 60 as compared to a coarser microstructure in base portion 15. Material in bond layer 65 may include a blended microstructure, as evident in FIG. 4. In one embodiment, the microstructure gradient may be transitionless, meaning that no defining line between the finer and coarser microstructures is evident at 100× magnification. To the unaided eye, the macrostructure may appear to have a line between the two regions. As also discussed above, the finer microstructure may have a relatively greater thermal fatigue resistance than the coarser microstructure. In the case of gray cast iron, cooling component 10 may result in a smaller flake size in the adjacent filler material than the flake size of the surrounding base material, approximately as shown in FIG. 4.

It will be recalled that bridges 204 reside at thermal fatigue sensitive locations, where cracks may form and propagate in service. In the illustrated embodiment, insert portions 60 are sized such that the entirety of bridges 204 are resident therein. In other embodiments, insert portions 60 might be relatively smaller, such that each of valve openings 20 is located in part within one of insert portions 60 and in part within base portion 15. It has nevertheless been discovered that locating the blended microstructure radially outboard of a radial center point 202 of each of bridges 204 can impart desired thermal fatigue resistance properties. Thus, some or all of each one of bridges 204 may have the finer flake microstructure, with the blended microstructure being outboard center points 202, and the coarser flake microstructure being still further outboard. The improved thermal fatigue resistance is believed to be due at least in part to the finer microstructure of the filler material being less likely to crack in the first place, resistant to propagating cracks within the solidified filler material, and also resistant to propagating cracks from the filler material to adjacent base material. In particular, it is believed that the blended microstructure within bond layer 65 can have a blend of different flake sizes, and thus imparts a gradient of crack formation and propagation tendencies ranging from less likely within the finer microstructure of insert portion 60 to more likely, but less needed, in the coarser microstructure of base portion 15. Another way to understand this general phenomenon, is that an inhomogeneous, crack-propagation-defeating microstructure in the base and insert portions, is formed via cooling component 10 in the manner described herein. As to cooling, it may be appreciated that accelerating a cooling of the filler material such as by way of compressed air not only cools the filler material, but also cools some adjacent base material. The adjacent base material in turn cools at a greater rate than the rest of the base material and base portion 15.

As also discussed above, component 10 may include a new component, formed wholly of cast material never placed in service. In other instances, base portion 15 might include a base portion removed from service in a machine system. For such an application, the present techniques for forming insert portion 60 and their associated microstructure, it will be understood that filler material may be used to replace machined away base material. In other words, existing base material of a cylinder head which includes cracked areas, and also base material which is free of cracks, may be excavated and replaced with void portions 30. This technique reflects the surprising discovery that cylinder heads having insert portions, and notably bridges between adjacent valve openings, which are formed according to the techniques set forth herein may have a longer service life or at least lower incidence of cracks and damage than designs where the entire cylinder head is formed as a single casting. Accordingly, in the case of gray iron materials, gray cast iron filler material having a finer microstructure and a smaller flake size may replace excavated gray cast iron base material having a larger flake size, and coarser microstructure.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of producing a new component for a machine system having dissimilar properties in a base portion and an insert portion of the component, the method comprising:

receiving a base portion of the component formed of a base material and never having been placed in service;

preheating the base portion;

adding a molten filler material for forming an insert portion of the component into a void in the base portion;

further heating preheated base material surrounding the void via the molten filler material such that the filler material chemically bonds with the surrounding base material; and cooling the component such that different microstructures according the dissimilar properties are formed in each of the surrounding base material of the base portion and adjacent filler material of the insert portion.

2. The method of claim 1 wherein cooling the component further includes cooling the component such that the surrounding base material and the adjacent filler material define a microstructure gradient according dissimilar fatigue resistance properties.

3. The method of claim 2 wherein cooling the component further includes cooling the component such that a coarser to finer microstructure gradient from the base portion to the insert portion accords a lesser thermal fatigue resistance to the surrounding base material and a greater thermal fatigue resistance to the adjacent filler material.

4. The method of claim 3 wherein the step of cooling the component further includes cooling the component such that the microstructure gradient is transitionless.

5. The method of claim 2 wherein preheating the base portion includes preheating a base portion formed of an iron containing base material, and wherein adding a molten filler material includes adding an iron containing filler material.

6. The method of claim 4 wherein preheating the base portion includes preheating a base portion formed of gray cast iron.

7. The method of claim 6 wherein cooling the component further includes cooling the component such that a flake size of the adjacent filler material is smaller than a flake size of the surrounding base material.

8. The method of claim 7 wherein preheating a base portion includes preheating a cylinder head, and wherein cooling the component further includes cooling the component such that the microstructure gradient resides on a fireside surface of the cylinder head.

9. The method of claim 5 wherein preheating a base portion includes preheating a base portion defining a finite number of voids, wherein adding a molten filler material further includes adding superheated molten filler material into all of the voids, and wherein cooling the component further includes cooling the filler material and base material surrounding each one of the voids via compressed air.

10. A method of preparing a new component for service in a machine system comprising:

receiving a base portion of the component never having been placed in service, the base portion being formed of a base material and defining a finite number of voids;

preheating the base portion;

adding a molten filler material into all of the voids;

further heating preheated base material surrounding each one of the voids via the molten filler material such that the filler material chemically bonds with the surrounding base material;

cooling the component such that an insert portion of cooled filler material forms within each one of the voids; and forming a first microstructure in the insert portions which is different from a second microstructure in the base portion, via cooling the component.

11. The method of claim 10 wherein forming further includes forming a blended microstructure at interfaces of the insert portions and the base portion.

12. The method of claim 11 wherein the first microstructure is finer than the second microstructure.

13. The method of claim 12 wherein the component includes a cylinder head for an internal combustion engine, and further comprising a step of forming a plurality of valve openings at least partially within each one of the insert portions.

14. The method of claim 13 wherein:

forming the plurality of valve openings includes positioning a plurality of removable plugs within each one of the voids;

forming the first microstructure includes forming the first microstructure within bridges, each extending between adjacent valve openings; and forming the blended microstructure further includes forming the blended microstructure at locations outboard of a radial center point of each one of the bridges.

15. A method of preventing thermal fatigue damage in a component of a machine system comprising:

receiving a base portion of the component removed from service in a machine system and being formed of a base material;

removing base material from the base portion at thermal fatigue sensitive locations where the base material is cracked and at thermal fatigue sensitive locations where the base material is free of cracks, such that a finite number of voids are formed in the base portion in place of the removed base material, and wherein the locations where the base material is cracked are not adjacent to the locations where the base material is free of cracks;

heating the base portion at least in part via adding a molten filler material into all of the voids, such that the filler material chemically bonds with base material surrounding each one of the voids;

cooling the component such that added filler material forms an insert portion within each one of the voids; and forming an inhomogeneous, crack-propagation-defeating microstructure in the base portion and in the insert portions, at least in part via cooling the component.

16. The method of claim 15 further comprising preheating the base portion to a temperature less than a melting temperature of the base material prior to adding the molten filler material.

17. The method of claim 16 wherein adding a molten filler material includes adding superheated molten filler material, and wherein cooling the component includes cooling the added filler material at a greater cooling rate than a cooling rate of the base material.

18. The method of claim 16 wherein the component includes a gray cast iron cylinder head for an internal combustion engine and the thermal fatigue sensitive locations include thermal fatigue sensitive bridges of the cylinder head, and wherein forming an inhomogeneous, crack-propagation-defeating microstructure further includes forming a finer flake microstructure within the thermal fatigue sensitive bridges of the cylinder head, forming a coarser flake microstructure outboard of the bridges, and forming a blended microstructure transitioning between the finer and coarser flake microstructures.

19. The method of claim 18 wherein forming a finer flake microstructure further includes replacing excavated gray cast iron base material having a coarser flake size with gray cast iron filler material having a smaller flake size at least in part via adding the molten filler material and cooling the component.

* * * * *